US006808399B2

(12) United States Patent
Rothermel et al.

(10) Patent No.: US 6,808,399 B2
(45) Date of Patent: Oct. 26, 2004

(54) ELECTRICAL CONNECTOR WITH WAFERS HAVING SPLIT GROUND PLANES

(75) Inventors: Brent Ryan Rothermel, Harrisburg, PA (US); Chad William Morgan, Mechanicsburg, PA (US); Alex Michael Sharf, Harrisburg, PA (US); David Wayne Helster, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/308,822

(22) Filed: Dec. 2, 2002

(65) Prior Publication Data

US 2004/0106311 A1 Jun. 3, 2004

(51) Int. Cl.[7] ..... H01R 4/66

(52) U.S. Cl. ..... 439/108; 439/608

(58) Field of Search ..... 439/108, 608, 439/79, 76.1, 607, 701, 77, 65, 609, 625, 631; 361/780, 794, 799, 777

(56) References Cited

U.S. PATENT DOCUMENTS 4,157,612 A * 6/1979 Rainal ..... 29/828
4,571,014 A * 2/1986 Robin et al. ..... 439/14 R
5,525,067 A * 6/1996 Gatti ..... 439/108
5,908,333 A * 6/1999 Perino et al. ..... 439/631
6,083,047 A 7/2000 Paagman
6,171,115 B1 * 1/2001 Mickievicz et al. ..... 439/76.1
6,220,896 B1 * 4/2001 Bertoncini et al. ..... 439/608
6,267,604 B1 * 7/2001 Mickievicz et al. ..... 439/79
6,461,202 B2 * 10/2002 Kline ..... 439/701
6,471,115 B1 * 10/2002 Ijuin et al. ..... 228/180.22
6,471,548 B2 * 10/2002 Bertoncini et al. ..... 439/608
6,506,076 B2 * 1/2003 Cohen et al. ..... 439/608
6,517,360 B1 * 2/2003 Cohen ..... 439/65
6,537,087 B2 * 3/2003 McNamara et al. ..... 439/108
6,540,558 B1 * 4/2003 Paagman ..... 439/608
6,544,045 B1 * 4/2003 Paagman ..... 439/79
6,544,072 B2 * 4/2003 Olson ..... 439/608
6,554,647 B1 * 4/2003 Cohen et al. ..... 439/607
6,572,410 B1 * 6/2003 Volstorf et al. ..... 439/608
6,652,318 B1 * 11/2003 Winings et al. ..... 439/608
6,655,966 B2 * 12/2003 Rothermel et al. ..... 439/76.1
6,672,886 B2 * 1/2004 Billman ..... 439/82
6,685,488 B2 * 2/2004 Billman et al. ..... 439/108
6,692,272 B2 * 2/2004 Lemke et al. ..... 439/108
2002/0009926 A1 1/2002 Mickievicz et al.

* cited by examiner

*Primary Examiner*—P. Austin Bradley
*Assistant Examiner*—Phuongchi Nguyen

(57) ABSTRACT

An electrical wafer configured to be housed within an electrical connector comprising a main body, and a plurality of signal routes, gap routes and ground planes. The plurality of signal routes, gap routes and ground planes may be positioned on each of the first and second sides of the main body. Alternatively, all of the signal routes may be on one side, while all of the ground planes may be on the other side. Each ground plane on one side of the wafer is positioned between two gap routes, or a gap route and a signal route.

13 Claims, 4 Drawing Sheets

ELECTRICAL CONNECTOR WITH WAFERS HAVING SPLIT GROUND PLANES

BACKGROUND OF THE INVENTION

The present invention generally relates to an electrical wafer or circuit board configured for use within an electrical connector, and more particularly to an electrical wafer having at least one split ground plane.

In the past, controlled impedance connectors have been proposed that are used as board-to-board connectors. Many connectors house a plurality of circuit boards, or electrical wafers, having edges that mate with edges of corresponding contacts in an adjoining connector. The connectors may electrically connect components, such as motherboards and daughterboards.

FIG. 7 is a cross-sectional view of a portion of a conventional electrical wafer 100. The electrical wafer 100 includes a main body 112 formed of a dielectric material, such as molded plastic. Signal tracks 114 are positioned on one side 102 of the electrical wafer 114 and may be separated from one another by a gap. The second side of the electrical wafer 104 includes at least one ground plane 116. As shown in FIG. 7, the ground plane 116 is shared by both signal tracks 114. Thus, electrical energy may travel from a first signal track to the ground plane 116 and into the second signal tracks (as shown by the arrows).

Examples of electrical connectors that utilize wafers are disclosed in United States Patent Application Publication US 2002/0009926 A1, filed Feb. 3, 2000 and published Jan. 24, 2002 ("the '926 application"). The '926 application is incorporated by reference herein in its entirety. The '926 application discloses an electrical connector that includes a housing that carries a plurality of wafers or circuit boards. FIG. 9 illustrates an electrical connector 1111 according to the '926 application. As shown in FIG. 9 (FIG. 1 of the '926 application), the electrical connector 1111 includes a housing 1112 having a front housing 1120 and an organizer 1130. Wafers 1113 having mating edges 1116 are received and retained within the housing 1112. The wafers 1113 extend parallel to each other in a spaced-apart relationship. The wafers 1113 include signal tracks that provide electrical paths through the connector. Each electrical path extends from a mating interface at one end of the connector to a mounting interface at another end of the connector.

The signal tracks of the wafers are separated by common ground planes. Ground planes may be provided on both sides of the wafer. At least a portion of the ground plane on one side of the wafer is located directly opposite a signal track on the opposite side of the wafer. Therefore, two signal tracks on a first side of the electrical wafer have a common return path to a ground plane, while a signal track on the second side of the wafer is directly across from the same ground plane through the main body of the wafer. The body of the wafer is typically a thin layer of dielectric material. Additionally, the signal track on the second side of the electrical wafer is typically separated from other signal tracks on the second side of the wafer by separate ground planes.

Electrical noise, jitter and the like generated by one signal track, or signal route, may pass into the ground plane. While the ground plane absorbs and alleviates noise and jitter, the ground plane may not entirely remove the noise and jitter. Hence, the ground plane may permit a small portion of the electrical noise, jitter and the like to pass from one signal track to another signal track. That is, the ground plane may couple with one signal track and act as an electrical conduit to another signal track, thereby allowing electrical noise and jitter to pass from one signal track to another signal track. Consequently, the signal tracks that share the same ground planes may still experience noise, jitter and the like thereby degrading performance within the electrical connector.

FIG. 8 is a cross-sectional view of a portion of another conventional electrical wafer 118. The electrical wafer 118 includes differential signal pairs 120 that each share a common ground plane 122. Thus, electrical energy may travel from one differential signal pair 120 to another differential signal pair through the common ground plane 122.

Many connector systems are arranged to convey signals arranged in differential pairs. Each differential pair includes complimentary signals such that if one signal in a differential pair switches from a zero logic state to a one logic state, the other signal in the differential pair switches from a one logic state to a zero logic state. If the differential pair signals are skewed in time with respect to one another, or if the transmission line characteristics of the signal tracks in a differential pair differ, cancellation between signals of the differential pair does not occur and a new current (resulting from the fact that the signals did not cancel) may be generated and passed to the ground plane. This new current is passed from one differential pair to another differential pair through the common ground plane, thereby causing interference and degrading performance within the connector.

Thus, a need exists for an electrical wafer that minimizes the effects of adjacent signal paths communicating with one another. Further, a need exists for an electrical wafer that exhibits less interference, cross-talk, jitter and the like.

BRIEF SUMMARY OF THE INVENTION

Certain embodiments of the present invention provide an electrical wafer configured to be housed within an electrical connector, comprising a main body and a plurality of signal routes and ground planes. The main body is formed of a dielectric material having first and second sides. The plurality of signal routes are positioned on a first side of the main body. Each of the signal routes comprises a signal contact pad at a mating edge of the electrical wafer, a signal terminal at a mounting edge of the electrical wafer, and a trace connecting the signal contact pad with the signal terminal. The plurality of ground planes positioned on the second side of the main body are positioned such that each of the ground planes is directly across from one of the plurality of signal routes located on the first side of the main body. Neighboring ground planes on the second side are separated by a ground-to-ground gap.

Certain embodiments of the present invention also provide an electrical wafer configured to be housed within an electrical connector comprising a main body, and a plurality of signal routes, gap routes and ground planes. The plurality of signal routes, gap routes and ground planes are positioned on each of the first and second sides of the main body. Each of the plurality of signal routes on one of the sides is located between two of the plurality of ground planes on the same side of the main body. Each of the ground planes on one side of the main body is positioned between one of the plurality of signal routes and one of the plurality of the gap routes on the same side of the main body.

Figure 1:
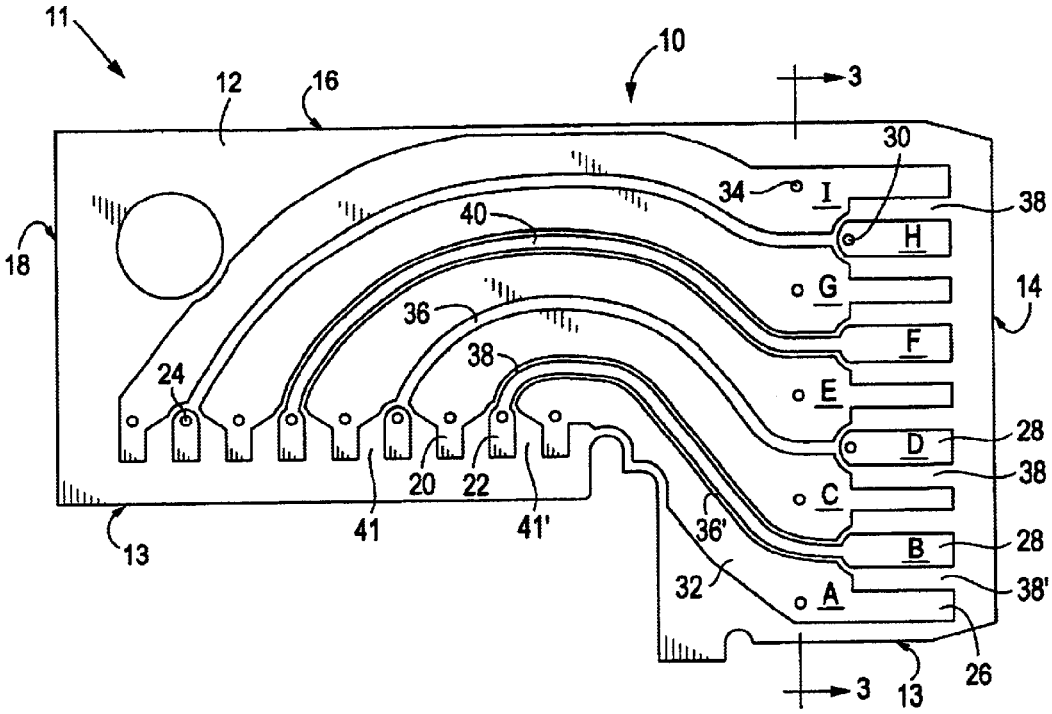
FIG. 1 illustrates an elevation view of a first side of an electrical wafer according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Figure 9:
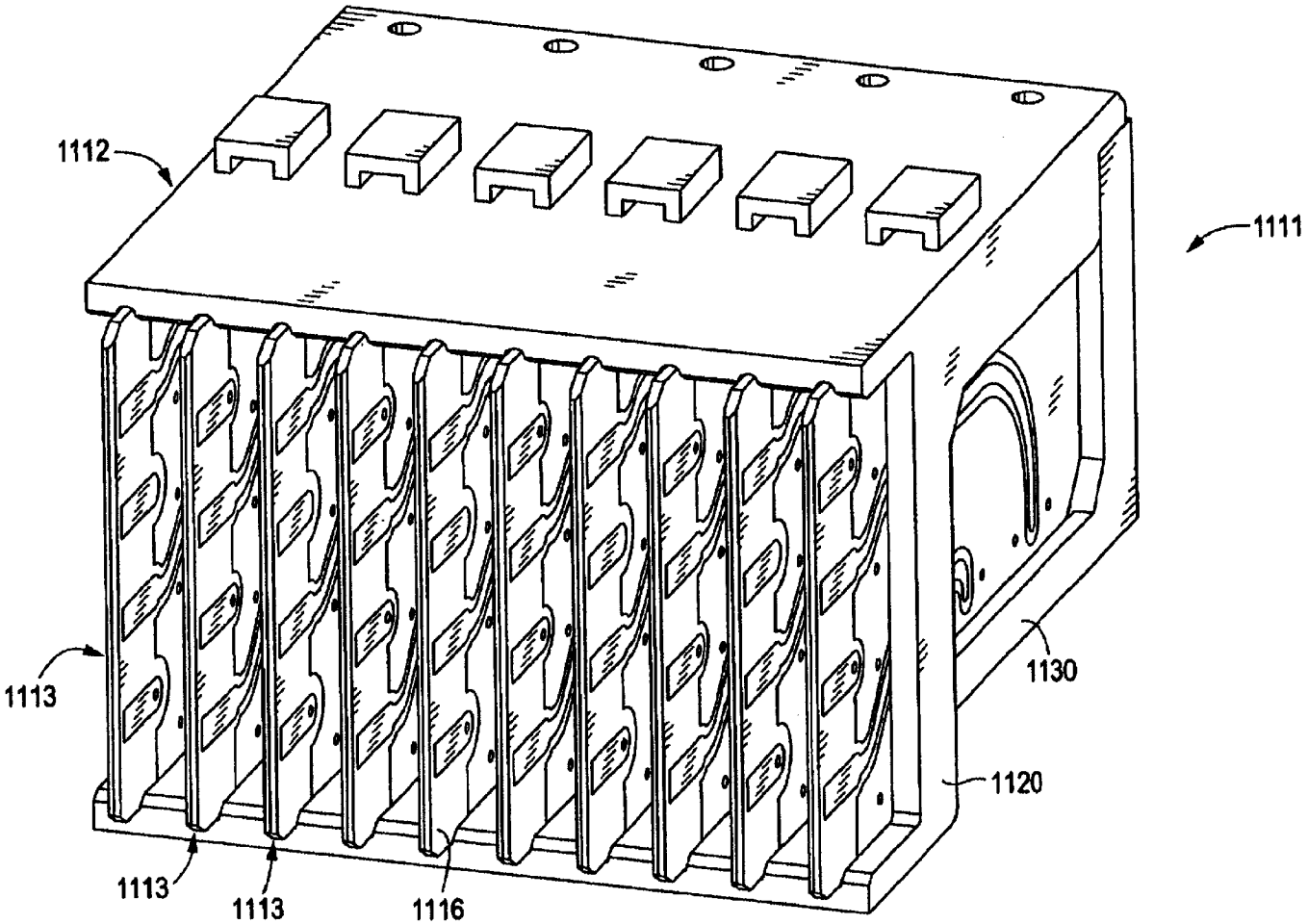
FIG. 9 illustrates an electrical connector according to the '926 application.

FIG. 1 illustrates an elevation view of a first side 10 of an electrical wafer 11. The wafer 11 includes a main body 12 defined by a mounting edge 13 configured to be received and retained within an organizer of an electrical connector housing, a mating edge 14 configured to mate with a mating edge of another wafer, a top edge 16 and a rear edge 18. The wafer 11 is configured to be received and retained within a connector housing, such as the housing 1112 shown in FIG. 9. A plurality of ground terminals 20 and signal terminals 22 are positioned proximate and along the mounting edge 13 in an alternating fashion. That is, each signal terminal 22 is positioned between two ground terminals 20. A via 24 is formed within each ground and signal terminal 20 and 22 and allows an electrical signal to travel from the first side 10 of the electrical wafer 11 to the second side 42 (shown in FIG. 2) of the electrical wafer 11.

A plurality of ground contact pads 26 and signal contact pads 28 are positioned proximate and along the mating edge 14 in an alternating fashion. Similar to the arrangement of the ground and signal terminals 20 and 22, each signal contact pad 28 is positioned between two ground contact pads 26. Some of the signal contact pads 28 include a via 30, which allows an electrical signal to travel from a signal contact pad 28 to the other side of the electrical wafer 10.

Each ground contact pad 26 is mechanically and electrically connected to a corresponding ground terminal 20 through a common ground plane 32. Each ground plane 32 includes a ground contact pad 26 and a corresponding ground terminal 20 and is preferably integrally formed as a single piece of material, such as copper. Each ground plane 32 has a via 34 positioned within the main body 12, distally located from the ground contact pads 26. As shown in FIG. 1, the electrical wafer 11 includes ground planes A, C, E, G and I on the first side 10.

A signal contact pad 28 may be mechanically and electrically connected to a corresponding signal terminal 22 through a signal trace 40, which may be formed integrally with the signal contact pad 28 and the signal terminal 22. The signal contact pads 28, signal terminals 22 and traces 40 are preferably integrally formed as a single piece of material, such as copper. As shown in FIG. 1, the electrical wafer 11 includes a plurality of signal routes, such as signal routes B, D, F and H. Each signal route may include a signal contact pad 28 and a corresponding signal terminal 22. Thus, each signal route extends from a signal contact pad 28 to a corresponding signal terminal 22. An active signal route, such as signal route F, includes a trace 40 that connects the signal contact pad 28 to the signal terminal 22. While the signal routes shown in FIGS. 1 and 2, for example, are single signal routes, the signal routes may also be differential pair signal routes. A gap route, such as signal route D, does not include a signal trace 40. Rather, a gap route includes a contact gap 38, which surrounds a signal contact pad 28, that connects to an intermediate gap 36, which in turn connects to a terminal gap 41, which surrounds a signal terminal 22.

Figure 2:
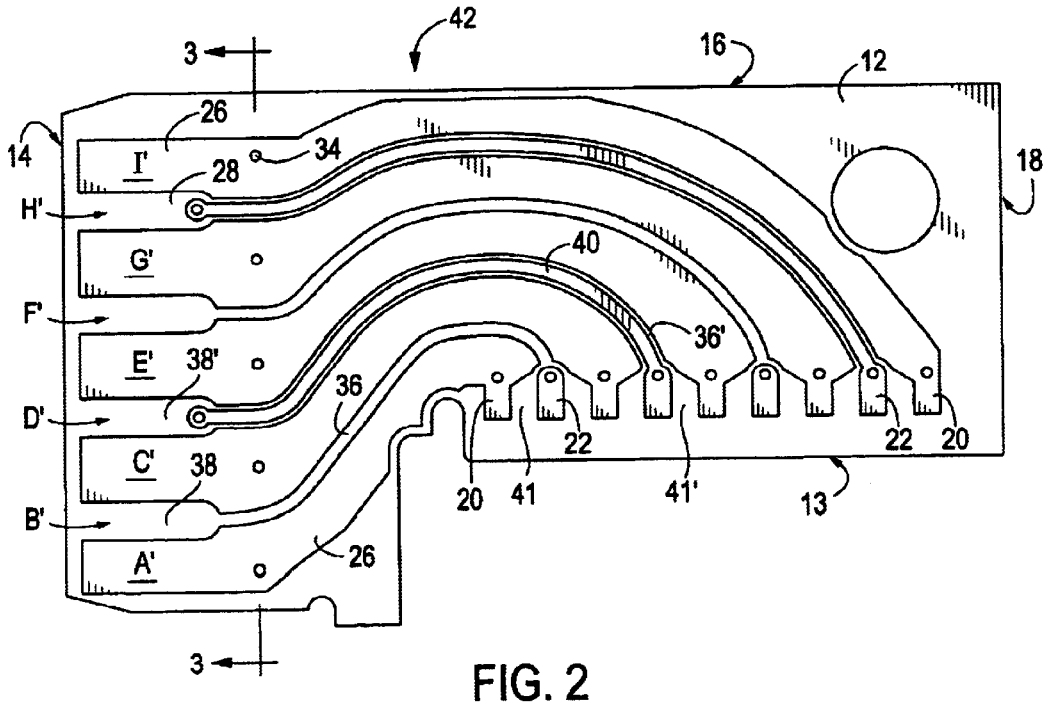
FIG. 2 illustrates an elevation view of a second side of an electrical wafer according to an embodiment of the present invention.

Signal routes B and F are connected through a trace 40. Conversely, gaps 36, 38 and 41 of non-conductive material are formed between the signal contact pads 28 and the signal terminals 22 of gap routes D and H. Further, as shown in FIG. 2, the signal contact pads 28 of signal routes D' and H' (the prime designation denotes the route on the other side of the electrical wafer 10) are electrically connected to their corresponding signal terminals 22 on the second side of the electrical wafer 11 (as shown in FIG. 2) through traces 40. Referring to FIGS. 1 and 2, while the signal terminals 22 of signal routes B and F are connected to corresponding signal contacts pads 28 on the first side of the wafer 10 through traces 40, the signal contact pads 28 and signal terminals 22 of gap routes B' and F' are surrounded by contact gaps 38 and 41, respectively, which, in turn, are connected through gap 36. That is, gaps 36, 38 and 41 of non-conductive material are formed between the signal contact pads 28 and signal terminals 22 of gap routes B' and F' on the second side of the electrical wafer 10. As more particularly shown in FIG. 3, while a trace 40 exists on one side of the electrical wafer 10, the area directly underneath, or on the other side of, that trace 40 is a gap route comprising gaps 36, 38 and 41 that are devoid of a conductive trace.

Spacers 36', 38' and 41' or gaps 36, 38 and 41 are formed between ground planes 32 and signal routes. For example, as shown in FIG. 1, ground plane A is separated from signal route B by contact spacers 38', which are connected to intermediate spacers 36', which are in turn connected to terminal spacers 41'. On the first side 10 of the wafer 10, ground planes A and C are separated from one another by a spacers 36', 38' and 41' and a signal trace 40 connected to a signal contact pad 28 and a signal terminal 22 positioned between the spacers 36', 38' and 41'. That is, ground planes A and C are separated by signal route B, which is an active signal route. Additionally, on the first side 10 of the electrical wafer 11, ground planes C and E are separated from one another by gaps 36, 38 and 41, which do not include a signal trace 40. That is, ground planes C and E are separated from one another by gap route D, which has no intervening signal trace 40 situated between ground planes C and E. The gaps 36, 38 and 41 do not include any conductive material. The spacers 36', 38' and 41' do not include conductive material and are defined by a top surface of the main body 12 and an outer lateral edge of an adjacent ground plane 32 and an outer lateral edge of an adjacent trace 40, signal contact pad 28, and signal terminal 22, respectively. The gaps 38 are formed so that electrical communication between adjacent ground planes 32 is minimized or reduced to tolerable levels.

The gaps 36, 38 and 41 and spacer 36', 38' and 41' follow the contours of the signal and ground planes. For example, signal route B includes a trace 40 that electrically connects the signal contact pad 28 of signal route B to the signal terminal 22 of signal route B. The signal trace 40 (and the rest of signal route B) is positioned between two intermediate spacers 38', which conform to the shape of the signal trace 40 and the adjacent ground plane A (on one side of the signal trace 40) and the adjacent ground plane C (on the other side of the signal trace 40). Alternatively, the gaps 36, 38 and 41 and the spacers 36', 38' and 41' may not follow the contours of the signal and ground planes, but may instead be non-uniform.

FIG. 2 illustrates an elevation view of a second side 42 of an electrical wafer 11. As shown in FIG. 2, gap route B', which is associated with signal route B on the first side 10 of the electrical wafer 11, includes a non-conductive path defined by contact gap 38, intermediate gap 36 and terminal gap 41. Similar to FIG. 1, the signal contact pads 28 and the signal terminals 22 of the gap routes include vias 30 and 24, respectively, that allow electrical signals to pass to the opposite side of the electrical wafer 11.

Figure 3:
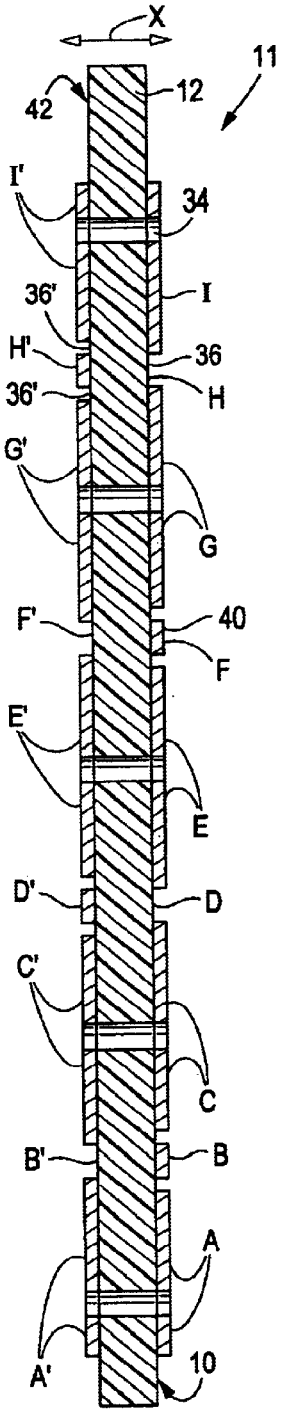
FIG. 3 is a cross-sectional view of an electrical wafer taken along line 3—3 in FIG. 2 according to an embodiment of the present invention.

FIG. 3 is a cross-sectional view of an electrical wafer 11 taken along line 3—3 in FIG. 2. Gap route B' is a mirror image of signal route B, which is located directly across from gap route B'. Thus, because signal route B includes a signal trace 40, the gap route B' includes a non-conductive path defined by gaps 36, 38 and 41. The same holds true for routes D–D', F–F' and H–H' in that if a signal route 28 includes a signal trace 40 on one side of the electrical wafer 11, the associated gap route on the other side of the electrical wafer 11 does not include a signal trace 40. That is, a gap route mirrors an active signal route, which is located directly across from the gap route. Hence, where signal traces 40 exist on a first side 10 of the electrical wafer, the region on the second side 42 corresponding to the signal traces 40 on the first side 10 is a gap 38. The ground planes 32 are separated on each side of the electrical wafer 11 so that a signal trace 40 on the opposite side is not positioned directly opposite that of a ground plane 32. Because the ground planes 32 are separated from one another by gaps 36, 38 and 41, the progress of electrical signals from one ground plane 32 to an adjacent ground plane 32 is hindered, diminished or eliminated.

As shown in FIG. 3, a signal trace 40 on one side of the electrical wafer 11 is associated with an intermediate gap 36 on the other side located directly opposite that of the signal trace 40. The ground planes on one side of the electrical wafer 10 are separated by a distance equaling at least the width of signal trace 40 on the opposite side of the electrical wafer 11. For example, the signal trace 40 of signal route H' on the second side of the electrical wafer 11 is mirrored on the first side 10 by (that is, located directly across from) the intermediate gap 36 of gap route H. Further, the trace 40 of signal route H' is separated from ground planes I' and G' by intermediate spacers 36' formed between the trace 40 and the ground planes G' and I'. Thus, no part of the signal route H' abuts an adjacent ground plane (such as ground planes H' and I'), nor does the gap route H (which is on the first side 10) include any ground plane material. Rather, the gap route H includes the contact gap 38, intermediate gap 36 and terminal gap 41, but no trace 40. The area across from a signal trace 40 in the lateral direction denoted by line X is an intermediate gap 36. Similarly, the signal contact pads 28 connected to a signal trace 40 may be across from a contact gap 38 in the X-direction. In other words, an active signal route, such as signal route B, may be mirrored by a gap route defined by a contact gap 38, an intermediate gap 36 and a terminal gap 41 of dielectric material, but without any conductive materials contained thereon.

Because the ground planes 32 are separated from one another, there is no common path for energy, in the form of cross-talk, noise and jitter, to travel from a lower signal route, such as signal route A, to an upper signal route, such as signal route H'. Thus, any energy that does travel from a lower signal route to an upper signal route is attenuated, as compared to conventional wafers. There is no ground plane material across from the signal route H' (i.e., gap route H) to act as a conductive path or coupling structure over which energy may travel. Because there is no conductive path across from signal route H', any energy that does travel from signal route H' to signal route F is attenuated. Similarly, energy that may travel among other signal routes, such as signal routes B, D', F and H', is attenuated, diminished, reduced or minimized.

Figure 4:
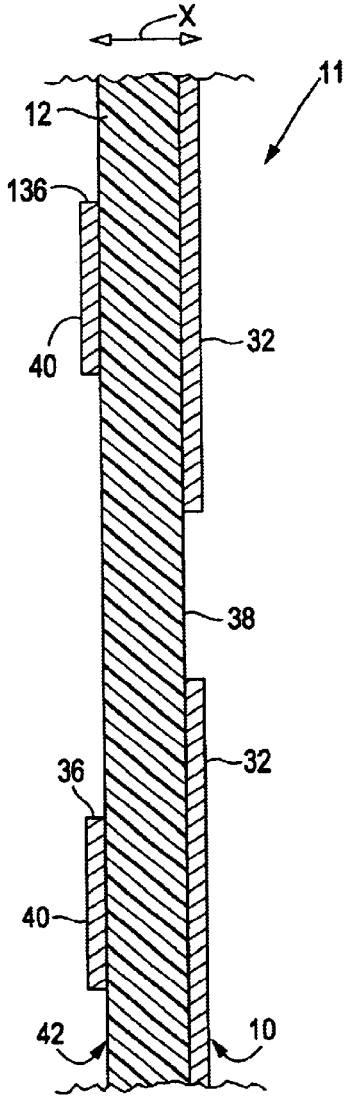
FIG. 4 is a cross-sectional view of a portion of an electrical wafer according to an alternative embodiment of the present invention.

FIG. 4 is a cross-sectional view of a portion of the electrical wafer 11 according to an alternative embodiment of the present invention. In this embodiment, each trace 40 and/or signal route 36 and 136 is associated with one ground plane 32. Also, as shown in FIG. 4, all signal routes 36 and 136 are on one side, for example the second side 42, of the electrical wafer 11, while the associated ground planes 32 are on the opposite side, such as the first side 10, of the electrical wafer 11. Thus, the majority of any electrical energy in the form of cross-talk, jitter, etc., from a trace 40 and/or signal route 36 and 136 travels from the dielectric material in the main body 12, such as plastic, into an associated ground plane 32. Any energy that travels from one signal route 36 to another signal route 136 is attenuated, or otherwise reduced. However, most, if not all, of any such electrical energy does not travel from one ground plane 32 to an adjacent ground plane 32.

Figure 5:
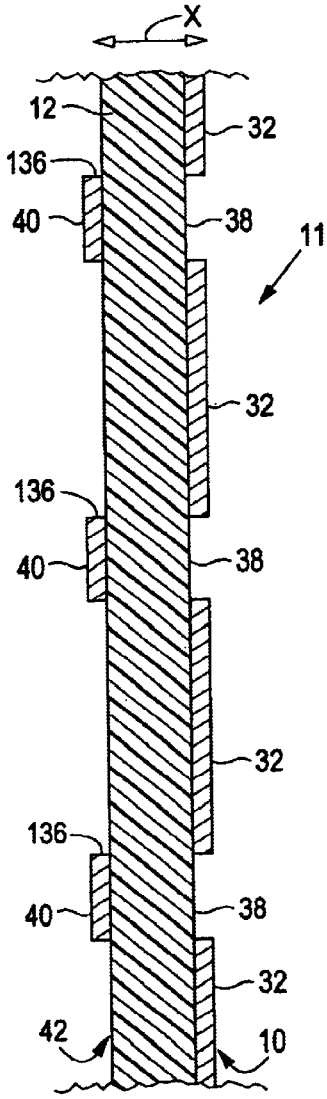
FIG. 5 is a cross-sectional view of a portion of an electrical wafer according to a second alternative embodiment of the present invention.

FIG. 5 is a cross-sectional view of a portion of the electrical wafer 111 according to a second alternative embodiment of the present invention. The embodiment shown in FIG. 5 is similar to that of FIGS. 1-3, except that all the signal routes 136 are on one side, for example the second side 42, of the electrical wafer 11, while the associated ground planes 32 are on the first side 10. Similar to the embodiments shown in FIGS. 1-3, the signal routes 136 are directly across, in the direction denoted by line X, from gap routes having intermediate gaps 38. Thus, while energy may travel from the lower signal route 136 to the middle signal route 136 through the ground plane 32 on side 10 between the two signal routes 136, energy does not travel from the lower signal route 136 to the upper signal route 136. Most, if not all, of any such electrical energy does not travel to and from adjacent ground planes 32 because there is no conductive material over which the energy may travel.

Figure 6:
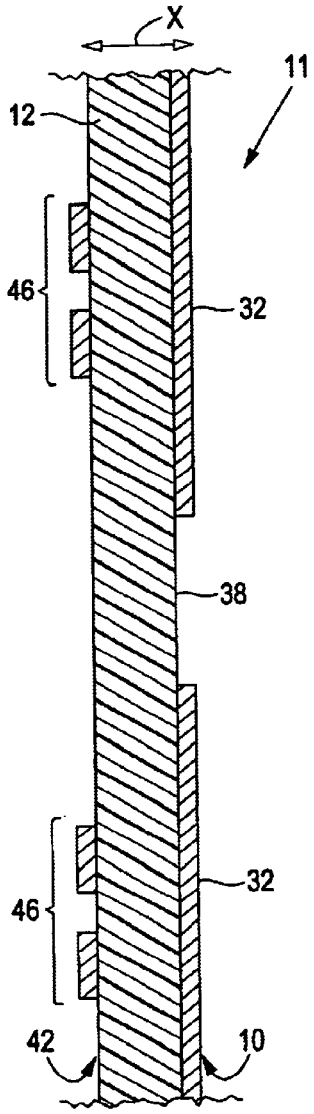
FIG. 6 is a cross-sectional view of a portion of an electrical wafer according to a third alternative embodiment of the present invention.
Figure 7:
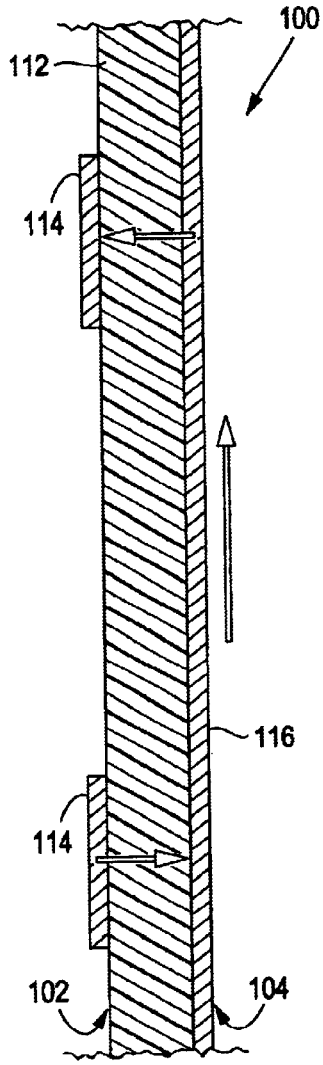
FIG. 7 PRIOR ART
FIG. 7 is a cross-sectional view of a portion of a conventional electrical wafer.
Figure 8:
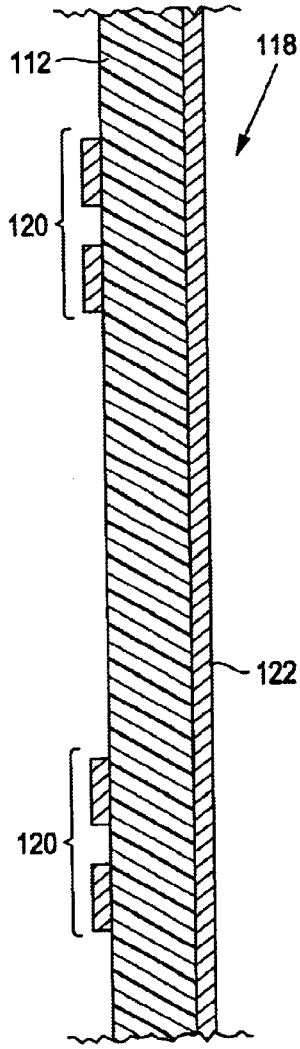
FIG. 8 PRIOR ART
FIG. 8 is a cross-sectional view of a portion of another conventional electrical wafer that utilizes differential signal pairs.

FIG. 6 is a cross-sectional view of a portion of the electrical wafer 11 according to a third alternative embodiment of the present invention. Differential signal pairs 46 are used in this embodiment. Each differential signal pair 46 is associated with a single, distinct ground plane 32. Thus, electrical energy in the form of noise, jitter, cross-talk and the like from one differential signal pair 46 may travel to the associated ground plane 32, but not to another ground plane 32. Alternatively, each differential signal pair 46 may be positioned across from, in the direction denoted by line X, a gap route having a gap 38, with ground planes 32 being positioned between gaps 38 (similar to the embodiments shown with respect to FIGS. 1-3 and 5).

Thus, embodiments of the present invention provide an electrical wafer that minimize the effects of adjacent signal paths communicating with one another due to the ground planes being separated from one another. That is, each ground plane is associated with only one signal path or plane. Because the ground planes are separated from one another, most or all of any electrical energy does not travel from one ground plane to another ground plane positioned on the same side of the electrical wafer. Overall, embodiments of the present invention provide an electrical wafer that produces less interference, cross-talk, jitter and the like.

The electrical wafer may include more or less ground planes and signal routes than those shown. For example, each side of the electrical wafer may include more or less than the four signal routes shown. The electrical wafer may have a main body having first and second sides that are integrally formed with one another; or each side may be a separate component that may be snapably or otherwise fixedly secured to its counterpart or a connecting intermediate member. Embodiments of the present invention may be used with any electrical connector that utilizes electrical wafers. Further, embodiments of the present invention may be used with systems that may benefit from the reduction of cross-talk, interference, jitter and the like among signal routes, paths, traces and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical wafer configured to be housed within an electrical connector, comprising:

a main body formed of a dielectric material having first and second sides;

a plurality of signal routes positioned on said first side of said main body, each of said signal routes comprising a conductive trace; and a plurality of ground planes positioned on said second side of said main body such that each of said ground planes is located directly across from one of said plurality of signal routes located on said first side of said main body, wherein neighboring ground planes on said second side are electrically isolated and separated from one another by a ground-to-ground gap.

2. The electrical wafer of claim 1, wherein said signal routes comprise at least one of single signal routes and differential signal pairs.

3. The electrical wafer of claim 1, wherein each of said signal routes on said first side is directly across from a respective one of said ground planes on said second side.

4. The electrical wafer of claim 1, wherein said ground-to-ground gap is a non-uniform gap route.

5. The electrical wafer of claim 1, further comprising vias that allow an electrical signal to pass from said first side of said main body to said second side of said main body.

6. An electrical wafer configured to be housed within en electrical connector comprising:

a main body formed of a dielectric material having first and second sides; and a plurality of signal routes, gap routes and ground planes positioned on each of said first and second sides of said main body, each of said plurality of signal routes on one of said sides is located between two of said plurality of ground planes on said one side, and each of said ground planes on said one side is positioned between one of said plurality of signal routes and one of said plurality of said gap routes on said one side.

7. The electrical wafer of claim 6, wherein said signal routes comprise a trace electrically connected to a signal terminal at a mounting edge of said electrical wafer and a signal contact at a mating edge of said electrical wafer.

8. The electrical wafer of claim 6, wherein each of said plurality of signal routes comprises a signal trace and a spacer positioned on each side of said signal trace, and wherein each of said plurality of gap routes is devoid of a signal trace.

9. The electrical wafer of claim 6, wherein said signal routes comprise at least one of single signal routes and differential signal pairs.

10. The electrical wafer of claim 6, wherein each of said signal routes on one of said sides is directly across from one of said gap routes on the other of said sides.

11. The electrical wafer of claim 6, further comprising vias that allow an electrical signal to pass from said first side of said main body to said second side of said main body.

12. An electrical wafer comprising:

a dielectric main body having respective opposite sides;

a plurality of signal routes on one of said sides and a plurality of ground planes on the other of said sides, wherein said ground planes are separated from each other by ground-to-ground gaps, and each of said signal routes on said one side is directly across from one of said ground-to-ground gaps on said other side.

13. An electrical wafer comprising:

a dielectric main body having respective opposite sides;

a plurality of signal routes and a plurality of ground planes on one of said sides, wherein said signal routes are spaced-apart and all of said signal routes are separated from each other by respective pairs of said ground planes;

wherein each of said pairs includes two ground planes that are separated from each other by a gap.

* * * * *